US005582942A

United States Patent [19]

Yokoya et al.

[11] Patent Number: 5,582,942

[45] Date of Patent: Dec. 10, 1996

[54] PRINTING PLATE FOR ELECTROPHOTOGRAPHIC TYPE PLATE MAKING

[75] Inventors: Hiroaki Yokoya; Hiromichi Tachikawa, both of Kanagawa, Japan

[73] Assignee: Fuji Photo Film Co., Ltd., Kanagawa, Japan

[21] Appl. No.: 335,411

[22] Filed: Apr. 10, 1989

[30] Foreign Application Priority Data

Apr. 8, 1988 [JP] Japan ..... 63-87024

[51] Int. Cl.[6] ..... G03G 13/28; G03G 5/00

[52] U.S. Cl. ..... 430/49; 430/96

[58] Field of Search ..... 430/49, 96

[56] References Cited

U.S. PATENT DOCUMENTS 4,500,622 2/1985 Horie et al. ..... 430/78
4,792,511 12/1988 Kato et al. ..... 430/87
4,828,952 5/1989 Kato et al. ..... 430/87
4,910,109 3/1990 Yokoya et al. .
5,006,433 4/1991 Yokoya et al. ..... 430/49
5,049,463 12/1991 Kato et al. ..... 430/49
5,079,116 1/1992 Tachikawa et al. ..... 430/49

*Primary Examiner*—George F. Lesmes
*Assistant Examiner*—B. P. Codd
*Attorney, Agent, or Firm*—Sughrue, Mion, Zinn, Macpeak & Seas

[57] ABSTRACT

A printing plate for electrophotographic type plate making having a photoconductive layer on an electrically conductive support. The photoconductive layer includes an organic photoconductive compound and a binding resin containing a copolymer including an acrylic acid ester or methacrylic acid ester having an aromatic ring and a vinyl polymerizable monomer having one to three acidic functional groups.

15 Claims, 3 Drawing Sheets

PRINTING PLATE FOR ELECTROPHOTOGRAPHIC TYPE PLATE MAKING

FIELD OF THE INVENTION

This invention concerns printing a plate for electrophotographic type plate making, which have a photoconductive layer which contains an organic photoconductive compound. After forming a toner image by means of an electrophotographic method, printing plates are formed by removing the photoconductive layer of the non-image forming parts other than the toner image parts. More precisely, this invention concerns printing plates for electrophotographic type plate making which have improved responsiveness to light and with which it is possible to shorten the plate making time by shortening the time from the completion of the exposure to the start of toner development.

BACKGROUND OF THE INVENTION

Today, PS (presensitized) plates in which positive type photosensitive agents of which the principal components are a diazo compound and a phenolic resin, or negative type photosensitive agents of which the principal components are acrylic based monomers or prepolymers, are being used for lithographic offset printing plates. These plates have low sensitivity. Plate making is carried out by attaching thereto a pre-imagewise recorded film original and exposing the plate to light.

On the other hand, as a result of processing which has been made in computer graphics processing and large capacity data storage coupled with data transmission techniques, in recent years, electronic editing systems, in which everything from original input, correction, editing and layout to page compilation is handled by computer and can be sent out immediately to terminal plotters in distant locations by means of a high speed communication network or by satellite communication, have been placed into practical use. The need for electronic editing systems is especially great in the newspaper printing field where immediacy is essential. Furthermore, as a result of the development of ultralarge capacity memory devices, such as optical disks, consideration has been-given to the storage of originals as digital data on these recording media in fields where the original is stored as a master film and a plurality of printing plates are made, as required, on the basis of the stored original.

However, practical direct type basic printing plates from which a printing plate can be made directly from the output of a terminal plotter are not available Even when an electronic editing system has been used, the output is materiallized using a silver salt based photographic film in practice and the printing plate is produced indirectly on the basis of this film which is attached to a PS plate which is then exposed. One of the reasons for this is the difficulty involved in the development of direct type printing plates which have a sufficiently high speed to enable the printing plate to be made in a practical period of time using the light sources of output plotters (for example, He—Ne lasers and semiconductor lasers).

Electrophotographic photoreceptors are highly sensitive to light and could provide direct type printing plates. Many printing plates for electrophotographic type plate making of the type in which the photoconductive layer in the non-image parts is removed after forming a toner image are well known. Thus, printing plates for electrophotographic type plate making have been disclosed, for example, in JP-B-37-17162, JP-B-38-6961, JP-B-38-7758, JP-B-41-2426, JP-B-46-39405, JP-A-50-19509, JP-A-50-19510, JP-A-52-2437, JP-A-54-145538, JP-A-54-134632, JP-A-55-105254, JP-A-55-153948, JP-A-55-161250, JP-A-57-147656, and JP-A-57-161863. (The terms "JP-A" and "JP-B" as used herein mean "unexamined published Japanese patent application" and "examined Japanese patent publication" respectively.)

Because it is necessary to remove the non-image parts by etching to expose a hydrophilic surface in order to use an electrophotographic photoreceptor as a printing plate, binder resins which dissolve or swell in alkaline solvents and are then stripped away are often used as binder resins. Normally, these resins which dissolve or swell in alkaline solvents have poor compatibility with organic photoconductive compounds when compared to the polycarbonate resins which are widely used as binder resins for electrophotographic photoreceptors and, consequently, the amount of organic photoconductive compound which can be introduced into the electrophotographic photosensitive layer is limited. Even if sufficient amount of carriers for eliminating the surface potential is formed in the photoconductive layer, if the organic photoconductive compound content in the photoconductive layer is low, then the rate of migration of the carriers in the photoconductive layer is reduced and the rate at which the surface potential falls is low, which is to say the response rate is low. Consequently, after the completion of exposure, the time period from that the surface potential has been reduced sufficiently so that fogging does not occur to that toner development can commence is prolonged. The response time becomes longer as the exposure brightness is increased for a shortened exposure time in order to shorten the processing time as much as possible. Hence, the slowness of the response time greatly impedes any shortening of the overall processing time. Furthermore, other problems arise in cases where a scanning exposure is carried out using a high brightness light source such as laser light source. Thus, if the response rate is low, the rate of reduction of the surface potential differs in the parts where write-in starts and finishes, and so there is no fogging in the parts where write-in starts but fogged images are formed where write-in finishes and irregularity inevitably occur when a printing plate is made. Known binder resins which have been used in the past in printing plates for electrophotographic type plate making include styrene/maleic anhydride copolymers, vinyl acetate/crotonic acid copolymers, vinyl acetate/maleic anhydride copolymers and phenolic resins as disclosed, for example, in JP-B-41-2426, JP-B-37-17162, JP-B-38-6961, JP-A-52-2437, JP-A-54-19803, JP-A-54-134632, JP-A-55-105254, JP-A-50-19509 and JP-A-50-19510. However, various problems are known to arise when these are used in printing plates for electrophotographic plate making in which organic photoconductive compounds are used. Thus, the formed film is hard and cracking occurs when the printing plate is flexed in cases where a styrene/maleic anhydride copolymer has been used as a binder resin. Furthermore, film adhesion is poor and unable to withstand the printing of a large number of copies. The film which is formed is brittle and has poor printing durability when a phenolic resin has been used as a binder resin. Problems also arise with printing durability when a phenolic resin has been used as a binder resin. Problems also arise with printing durability when vinyl acetate/crotonic acid copolymers and vinyl acetate/maleic anhydride copolymers are used.

The use of copolymers of acrylic acid ester monomers or methacrylic acid monomers with monomers which contain a carboxylic acid has been suggested in JP-A-57-161863 and JP-A-58-76843 as a means of overcoming the various problems which result in poor printing durability, principally of the type described above. It is possible to use printing plates for electrophotographic type plate making if these resins are used, but the problems which have arisen in recent years due to the slow response rate, as mentioned earlier, have still not been resolved.

SUMMARY OF THE INVENTION

The first object of the invention is to provide printing plates for electrophotographic type plate making which have good sensitivity and a rapid response rate.

The second object of the invention is to provide printing plates for electrophotographic type plate making which are suitable for image formation using a scanning exposure with, for example, a laser.

The third object of the invention is to provide printing plates for electrophotographic type plate making which have excellent printing durability.

Thus, as a result of thorough research by the inventors, the present invention has been made as follows:

(1) Printing plates for electrophotographic type plate making which have at least a photoconductive layer comprising an organic photoconductive compound and a binding resin on an electrically conductive support and with which printing plates are made by removing the photoconductive layer of the non-image parts other than the toner image parts after imagewise exposure and forming a toner image, the improvement wherein the binder resin for the photoconductive layer is a copolymer which has an acrylic acid ester or methacrylic acid ester containing an aromatic ring as at least one of its monomer components and a vinyl polymerizable monomer which has one to three acidic functional groups as at least one other its of monomer components.

(2) Printing plates for electrophotographic type plate making as disclosed in (1) with which the aforementioned imagewise exposure is made by means of a scanning exposure with, for example, laser light or light emitting diodes.

Preferred embodiments of this invention are described under (3) to (10) below.

(3) Printing plates for electrophotographic type plate making as disclosed in (1) wherein the aromatic ring of the aforementioned acrylic acid ester or methacrylic acid ester which has an aromatic ring is an aromatic hydrocarbon.

(4) Printing plates for electrophotographic type plate making as disclosed in (1) wherein the aforementioned acrylic acid ester or methacrylic acid ester which has an aromatic ring is selected from among substituted or unsubstituted benzyl acrylate, benzyl methacrylate, phenethyl acrylate, phenethyl methacrylate, phenyl acrylate and phenyl methacrylate.

(5) Printing plates for electrophotographic type plate making as disclosed in (1) wherein the acidic functional group of the aforementioned vinyl polymerizable monomer which has one to three acidic functional groups is selected form among a carboxyl group, an acid anhydride group, a hydroxyl group, a phenolic hydroxyl group, a sulfonic group, a sulfonamido group and a sulfonimido group.

(6) Printing plates for electrophotographic type plate making as disclosed in (1) wherein the aforementioned vinyl polymerizable monomer which has one to three acidic functional groups is acrylic acid or methacrylic acid.

(7) Printing plates for electrophotographic type plate making as disclosed in (2) wherein the aromatic ring of the aforementioned acrylic acid ester or methacrylic acid ester which has an aromatic ring is an aromatic hydrocarbon.

(8) Printing plates for electrophotographic type plate making as disclosed in (2) wherein the aforementioned acrylic acid ester or methacrylic acid ester which has an aromatic ring is selected from among substituted or unsubstituted benzyl acrylate, benzyl methacrylate, phenethyl acrylate, phenethyl methacrylate, phenyl acrylate and phenyl methacrylate.

(9) Printing plates for electrophotographic type plate making as disclosed in (2) wherein the acidic functional group of the aforementioned vinyl polymerizable monomer which has one to three acidic functional groups is selected form among a carboxyl group, an acid anhydride group, a hydroxyl group, a phenolic hydroxyl group, a sulfonic group, a sulfonamido group and a sulfonimido group.

(10) Printing plates for electrophotographic type plate making as disclosed in (2) wherein the aforementioned vinyl polymerizable monomer which has one to three acidic functional groups is acrylic acid or methacrylic acid.

DETAILED DESCRIPTION OF THE INVENTION

Figure 1:
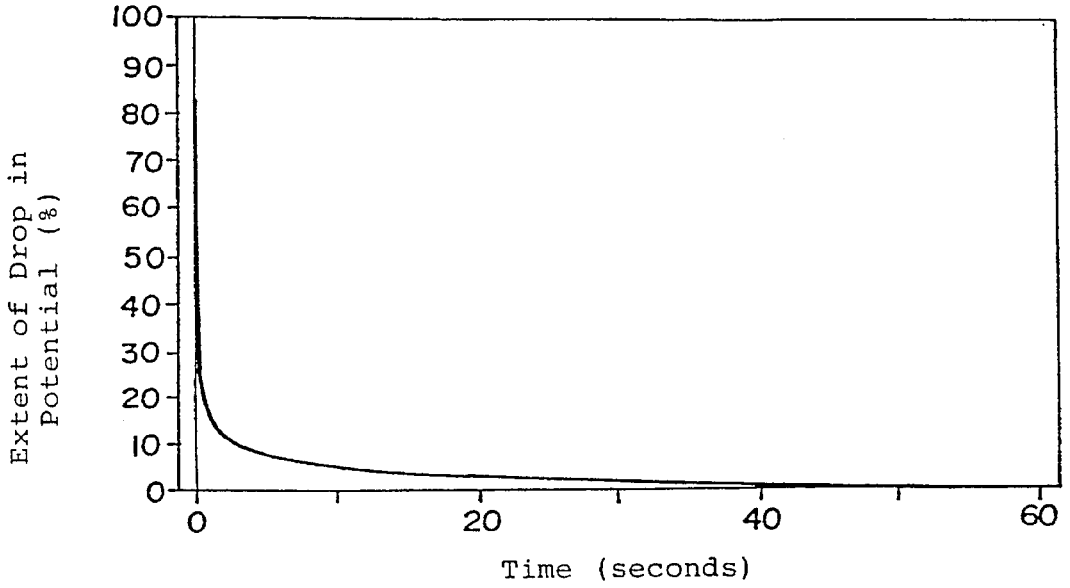
FIGS. 1 to 5 indicate the relationships between the passage of time (seconds) after exposure and the extent of the reduction of the surface potential (%) in Example 1 and Comparative Examples 1 to 4 respectively.

The acrylic acid esters or methacrylic acid esters which have an aromatic ring used in this invention may have as the ester residue an aromatic hydrocarbon group such as phenyl group, o-tolyl group, m-tolyl group, p-tolyl group, p-tert-butylphenyl group, chlorophenyl group, benzyl group, o-methylbenzyl group, m-methylbenzyl group, p-methylbenzyl group, p-ethylbenzyl group, p-propylbenzyl group, 2-phenylethyl group, 2-(p-methylphenyl)ethyl group, 2-(o-methylphenyl)ethyl group, 3-phenylpropyl group, α-naphthylmethyl group, β-naphthylphenyl group, or an aromatic heterocyclic group such as a 2-pyridinomethyl group, 4-pyridinomethyl group, imidazolylmethyl group, 4-indolylmethyl group, pyrimidinomethyl group, thiazolylmethyl group or furan, thiophene, pyrrole, pyran, thiopyran, thiazole, imidazole, pyrimidine, triazine, indole, quinoline, or purine.

In this invention, the aromatic ring groups may have substituent groups as indicated, for example, from among the specific examples described above. Further, substituent groups in this case include hydrogen atoms, alkyl groups, allyl groups, aryl groups, aralkyl groups, alkoxy group, aryloxy groups, alkoxycarbonyl groups, halogen atoms, nitro groups, amido groups, cyano groups, carbonyl groups, and dialkylamino groups. The preferred substituent groups are hydrogen atoms, alkyl groups which have from 1 to 5 carbon atoms, allyl groups which have from 1 to 5 carbon atoms, aryl groups which have from 6 to 10 carbon atoms, aralkyl groups which have from 1 to 10 carbon atoms, alkoxy groups which have from 1 to 5 carbon atoms, aryloxy groups which have from 6 to 10 carbon atoms, alkoxycarbonyl groups which have from 1 to 5 carbon atoms, halogen atoms, amino groups, nitro groups, cyano groups, trifluoromethyl groups, carboxyl groups, amido groups, and alkylamino groups substituted with alkyl groups which have from 1 to 5 carbon atoms.

Acrylic acid esters and methacrylic acid esters containing an aromatic ring which is an aliphatic hydrocarbon are preferred in this invention, and the preferred acrylic acid esters or methacrylic acid esters which have an aromatic ring are substituted or unsubstituted benzyl acrylate, benzyl methacrylate, phenethyl acrylate, phenethyl methacrylate, phenyl acrylate and phenyl methacrylate.

Examples of the acidic functional groups of the vinyl polymerizable monomers which have one to three acidic functional groups which can be used in the invention include carboxylic acid groups, acid anhydride groups, hydroxyl groups, phenolic hydroxyl groups, sulfonic acid groups, sulfonamido groups and sulfonamido groups. Specific examples of vinyl polymerizable monomers which have one to three acidic functional groups include acrylic acid, methacrylic acid, crotonic acid, maleic acid, phthalic acid, maleic anhydride, p-carboxystyrene, p-hydroxystyrene, p-hydroxyphenylacrylamide, hydroxyethl methacrylate, hydroxyethylmethacrylamide and p-vinylbenzenesulfonic acid. The preferred vinyl polymerizable monomers which have one to three acidic functional groups are acrylic acid and methacrylic acid.

The optimum copolymerization ratio of the acrylic acid ester or methacrylic acid ester which has an aromatic ring and the vinyl polymerizable monomer which has one to three acid functional groups in this invention varies according to types of monomers being used and the type of fluid (etching solution) which is to be used to remove the photoconductive layer, but the vinyl polymerizable monomer which has one to three acidic functional groups preferably accounts for from about 5 to 60 mol % and the acrylic acid ester or methacrylic acid ester which has an aromatic ring preferably accounts for from about 95 to 40 mol %, of the total monomer component. In cases where an alkali solvent which contains an aqueous alkali solution as the principal component is used as the etching solution, the vinyl polymerizable monomer which has one to three acidic functional groups more preferably accounts for from about 38 to 60 mol % and the acrylic ester or methacrylic acid ester which has an aromatic ring preferably accounts for from about 62 to 40 mol %, of the total monomer component. More than one of these essential two types of mononers can be used to form the total monomer content of each such type.

Furthermore, vinyl polymerizable monomers can also be included as third copolymer components in the binder resins of this invention. Examples of such vinyl polymerizable monomers include styrene derivatives, such as styrene, vinyltoluene, tert-butylstyrene and chlorostyrene, substituted and unsubstituted alkyl esters of acrylic acid or methacrylic acid, substituted and unsubstituted alkylamides of acrylic acid or methacrylic acid, acrylonitrile, vinylidene chloride and vinyl chloride.

Specific examples of binder resins of this invention are listed below, although the present invention is not limited thereto.

(1) Benzyl methacrylate/methacrylic acid (90:10)
(2) Benzyl methacrylate/methacrylic acid (80:20)
(3) Benzyl methacrylate/methacrylic acid (70:30)
(4) Benzyl methacrylate/methacrylic acid (60:40)
(5) Benzyl methacrylate/methacrylic acid (50:50)
(6) Benzyl methacrylate/methacrylic acid (60:40)
(7) Benzyl acrylate/acrylic acid (70:30)
(8) Benzyl methacrylate/acrylic acid (60:40)
(9) Phenyl acrylate/acrylic acid (60:40)
(10) Phenethyl methacrylate/methacrylic acid (65:35)
(11) Naphthylmethacrylate/methacrylic acid (60:40)
(12) Benzyl methacrylate/methyl methacrylate/methacrylic acid (50:20:30)
(13) Benzyl methacrylate/n-butyl methacrylate/methacrylic acid (50:10:40)
(14) Benzyl acrylate/ethyl methacrylate/acrylic acid (50:20:30)
(15) Phenyl methacrylate/hydroxyethyl methacrylate/acrylic acid (60:10:30)
(16) Benzyl methacrylatestyrene/methacrylic acid (40:10:50)
(17) 2-Pyridinomethyl methacrylate/vinyl toluene/acrylic acid (30:30:40)
(18) Benzyl methacrylate/ethyl methacrylate/methacrylamide/methacrylic acid (50:20:10:20)
(19) Benzyl acrylate/ethyl acrylate/itaconic acid (50:20:30)

The copolymerization ratio is shown by mole.

These binder resins can be prepared using a radical polymerization initiator by way of bulk polymerization, solution polymerization or suspension polymerization, and the methods of synthesis are generally well known. The molecular weight of the binder resin is satisfactory for use within the range from 1,000 to 500,000, but a molecular weight within the range form 8,000 to 150,000 is preferred from the viewpoint of the strength of the film which is formed and the rate of removal of the photoconductive layer.

The printing plates for electrophotographic type plate making in which an organic photoconductive compound is used of the type in which the photoconductive layer of the non-image parts are removed after forming a toner image can be classified into two types as indicated below. Those of the first type have a photoconductive layer of which the principal components are organic photoconductive compounds, sensitizing dyes and binder resins, as disclosed, for example, in JP-B-37-17162, JP-B-62-51462, JP-A-52-2437, JP-A-54-19803, JP-A-56-107246 and JP-A-57-161863, and those of the second type have a photoconductive layer of which the principal components are a charge generating agent, a charge transporting agent and a binder resin, as disclosed, for example, in JP-A-56-146145, JP-A-60-17751, JP-A-60-17752, JP-A-60-17760, JP-A-60-254142 and JP-A-62-54266. Photoconductive layers which have a double layer structure in which the charge generating agent and the charge transporting agent are included in separate layers, as disclosed, for example, in JP-A-60-230147, JP-A-60-230148, and JP-A-60-238853, are also known as examples of a special case of the second type. The printing plates for electrophotographic type plate making of this invention may be embodiments of either of the two types of photoconductive layer described above. In cases of the second type, the organic photoconductive compounds referred to in this invention function as charge transporting agents.

The following compounds are included among the organic photoconductive compounds which can be used in this invention:

(a) Triazole derivatives as disclosed, for example, in U.S. Pat. No. 3,112,197.

(b) Oxadiazole derivatives as disclosed, for example, in U.S. Pat. No. 3,189,447.

(c) Imidazole derivatives as disclosed, for example, in JP-B-37-16096.

(d) Polyarylalkane derivatives as disclosed, for example, in U.S. Pat. Nos. 3,615,402, 3,820,989 and 3,542,544, JP-B-45-555, JP-B-51-10983, JP-A-51-93224, JP-A-55-108667, JP-A-55-156953 and JP-A-56-36656.

(e) Pyrazoline derivatives and pyrazolone derivatives as disclosed, for example, in U.S. Pat. Nos. 3,180,729 and 4,278,746, JP-A-55-88064, JP-A-55-88065, JP-A-49-

105537, JP-A-55-51086, JP-A-56-80051, JP-A-56-88141, JP-A-57-45545, JP-A-54-112637 and JP-A-55-74546.

(f) Phenylenediamine derivatives as disclosed, for example, in U.S. Pat. No. 3,615,404, JP-B-51-10105, JP-B-46-3712, JP-B-47-28336, JP-A-54-83435, JP-A-54-110836 and JP-A-54-119925.

(g) Arylamine derivatives as disclosed, for example, in U.S. Pat. Nos. 3,567,450, 3,180,703, 3,240,597, 3,648,520, 4,232,103, 4,175,961 and 4,012,376, West German Patent No. 1,110,518, JP-B-49-35702, JP-B-39-27577, JP -A-55-144250, JP-A-56-119132 and JP-A-56-22437.

(h) Amino substituted chalcone derivatives as disclosed, for example, in U.S. Pat. No. 3,526,501.

(i) N,N-Bicarbazyl derivatives as disclosed, for example, in U.S. Pat. No. 3,542,546.

(j) Oxazole derivatives as disclosed, for example, in U.S. Pat. No. 3,257,303.

(k) Styrylanthracene derivatives as disclosed, for example, in JP-A-56-46234.

(1) Fluorenone derivatives as disclosed, for example, in JP-A-54-110837.

(m) Hydrazine derivatives as disclosed, for example, in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144.

(n) Benzidine derivatives as disclosed, for example, in U.S. Pat. Nos. 4,047,948, 4,047,949, 4,265,990, 4,273,846, 4,299,897 and 4,306,008.

(o) Stilbene derivatives as disclosed, for example, in JP-A-58-190953, JP-A-59-95540, JP-A-59-97148, JP-A-59-195658 and JP-A-62-36674.

(p) Polyvinylcarbazoles and derivatives thereof as disclosed, for example, in JP-B-34-10966.

(q) Vinyl polymers such as the polyvinylpyrene, polyvinylanthracene, poly-2-vinyl-4-(4'-dimethylaminophenyl)-5-phenyloxazole and the poly-3-vinyl-N-ethylcarbazole disclosed, for example, in JP-B-43-18674 and JP-B-43-19192.

(r) Phthalocyanine compounds such as the non-metal or metal phthalocyanine compounds disclosed, for example, in U.S. Pat. Nos. 3,397,086, 3,357,989, 4,666,802, JP-A-51-90827, JP-A-51-23738, JP-A-52-55643, JP-A-60-243089 and JP-A-61-115085.

(s) Polymers such polyacenaphthylene, polyindene and the acenaphthylene/styrene copolymers disclosed, for example, in JP-B-43-19193.

(t) Condensed resins such as the pyrene/formaldehyde resins, bromopyrene/formaldehyde resins and ethylcarbazole/formaldehyde resins disclosed, for example, in JP-B-56-13940.

(u) The various triphenylmethane polymers disclosed, for example, in JP-A-56-90883 and JP-A-56-161559.

Moreover, the organic photoconductive compounds are not limited to those described under (a) to (u) above, and any of the already known organic photoconductive compounds can be used in this invention. Depending on the particular case, it is also possible to use two or more of these organic photoconductive compounds conjointly.

The known sensitizing dyes used in the past in electrophotographic photoreceptors can be used as the sensitizing dyes which are included in photoconductive layers of the first type. These have been described, for example, in "Electrophotography", 12, 9 (1973) and "Organic Synthetic Chemistry", 24, (11), 1010, (1966) For example, use can be made of the pyrylium based dyes disclosed, for example, in U.S. Pat. Nos. 3,141,770 and 4,283,475, JP-B-48-25658 and JP-A-62-71965, the triarylmethane based dyes disclosed, for example, in "Applied Optics Supplement", 3, 50 (1969) and JA-50-39548, the cyanine dyes disclosed, for example, in U.S. Pat. No. 3,597,196 and the styril based dyes disclosed, for example, in JP-A-60-163047, JP-A-59-164588 and JP-A-60-252517.

Various organic and inorganic charge generating agents known in the past in connection with electrophotographic photoreceptors can be used as the charge generating agents which are used in photosensitive layers of the second type. For example, use can be made of selenium, selenium/tellurium, cadmium sulfide, zinc oxide and the organic pigments indicated under (1) to (9) below.

(1) Azo pigments such as the mono-azo, bis-azo and tris-azo pigments disclosed, for example, in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941 and JP-B-60-45664.

(2) Phthalocyanine pigments such as the non-metal or metal phthalocyanines disclosed, for example, in U.S. Pat. Nos. 3,397,086 and 4,666,802, JP-A-51-90827 and JP-A-52-55643.

(3) Perylene based pigments as disclosed, for example, in U.S. Pat. No. 3,371,884 and JP-A-47-30330.

(4) Indigo and thioindigo derivatives as disclosed, for example, in British Patent 2,237,680 and JP-A-47-30331.

(5) Quniacridone based pigments as disclosed, for example, in British patent 2,237,679 and JP-A-49-30332.

(6) Polycyclic quinone based pigments as disclosed, for example, in British Patent 2,237,678, JP-A-59-184348, JP-A-62-28738 and JP-A-47-18544.

(7) Bis-benzimidazole based pigments as disclosed, for example, in JP-A-47-30331 and JP-A-47-18543.

(8) Squalium salt based pigments as disclosed, for example, in U.S. Pat. Nos. 4,396,610 and 4,644,082.

(9) Azulenium salt based pigments as disclosed, for example, in JP-A-59-53850 and JP-A-61-212542.

These may be used individually or two or more types can be used conjointly.

The various known additives which have been used in the past in electrophotographic photoreceptors can be included in the photosensitive layers of the printing plates for electrophotographic type plate making of this invention. These additives include chemical sensitizers for improving electrophotographic sensitivity and various plasticizers and surfactants, etc., for improving film properties. Examples of chemical sensitizers include electron attracting compounds such as p-benzoquinone, chloranil, fluoranil, bromanil, dinitrobenzene, anthraquinone, 2,5-dichlorobenzoquinone, nitrophenol, tetrachlorophthalic acid anhydride, 2,3-dichloro-5,6-dicyanobenzoquinone, dinitrofluorenone, trinitrofluorenone, tetracyanoethylene, and the compounds disclosed, for example, in JP-A-58-65439, JP-A-58-102239, JP-A-58-129439 and JP-A-62-71965.

Plasticizers, such as dimethyl phthalate, dibutyl phthalate, dioctyl phthalate, triphenyl phosphate, diisobutyl adipate, dimethyl sebacate, dibutyl sebacate, butyl laurate, methylphthalylethyl glycolate, dimethylglycol phthalate, can be added to improve the flexibility of the photoconductive layer. These plasticizers can be included in amounts within the range where they do not cause any deterioration in the electrostatic characteristics or etching properties of the photoconductive layer.

The mixing ratio of the organic photoconductive compounds and binder resins in this invention is such that the upper limit for the organic photoconductive compound is set by the compatibility of the organic photoconductive compound with the binder resin. If an amount in excess of this limit is added, crystallization of the organic photoconductive compounds occurs and this is undesirable. The electrophotographic sensitivity falls as the organic photoconductive compound content is reduced and so the amount included is preferably as large as possible within the range where crystallization of the organic photoconductive material does not occur. The rate at which the organic photoconductive compound is included is from 5 to 120 parts by weight, and preferably from 10 to 100 parts by weight, per 100 parts by weight of binder resin. Furthermore, the organic photoconductive compounds can be used individually, or two or more types can be used conjointly.

Furthermore, a mixture of two or more types of resin can be used for the binder resin. In cases where a mixture of two or more binder resins is used, provided that at least one of these resins is a resin of this invention, the other resin(s) may be any of the resins known in the past as described earlier.

Furthermore, if the photoconductive layer in this invention is too thin it is not possible to charge the layer to the surface potential required for development, while if it is too thick, etching in the direction parallel to the surface, an effect known as side etching, occurs when the photoconductive layer is being removed and it is impossible to obtain good printing plates. The thickness of the photoconductive layer is from 0.1 to 30 μm, and preferably from 0.5 to 10 μm.

Electrically conductive supports which have a hydrophilic surface, for example, plastic sheets of which the surface is electrically conductive or, in particular, papers which have been rendered impermeable to solvents and electrically conductive, aluminum sheets, zinc sheets, or bimetal sheets such as copper/aluminum sheets, copper/stainless steel sheets, and chromium/copper sheets, or trimetal sheets such as chromium/copper/aluminum sheets, chromium/lead/iron sheets and chromium/copper/stainless steel sheets, can be used as the electrically conductive supports which are used in the invention. These supports preferably have a thickness of from 0.1 to 3 mm, and more preferably they have a thickness of from 0.1 to 0.5 mm. The aluminum sheets used in the invention are sheets of pure aluminum, or aluminum alloys of unspecified composition which contain trace quantities of other atoms and of which the principal component is aluminum, and the materials known in the past can be used depending on the purpose.

The aluminum plates may be sanded and anodized for use using the conventional methods. Prior to the sanding treatment, the sheet may be degreased using a surfactant or an aqueous alkali solution, as required, in order to remove the rolling grease from the surface of the aluminum sheet, and the sanding treatment is then carried out. The method of sanding may be a method in which the surface is roughened mechanically, a method in which the surface is dissolved electrochemically, or a method in which the surface is selectively dissolved chemically. Any of the known methods, such as ball polishing methods, brush polishing methods, blast polishing methods and buff polishing methods, can be used as methods by which the surface is roughened mechanically. Furthermore, methods in which either an alternating current or a direct current is applied in a hydrochloric acid or a nitric acid electrolyte can be used for roughening the surface electrochemically. Furthermore, use can also be made of those methods like that disclosed in JP-A-54-63902 where both these methods are combined.

The aluminum sheet of which the surface has been toughened can be subjected to an alkali etching treatment and neutralizing treatment, as required.

The aluminum sheets which have been treated as above can be subjected to an anodizing treatment. Sulfuric acid, phosphoric acid, oxalic acid, chromic acid or mixtures of these acids can be used as the electrolyte for the anodizing treatment. The electrolyte used and its concentration can be determined appropriately according to the type of electrolyte. The anodizing conditions can be varied according to the electrolyte which is being used and so no specifications are laid down in this connection but, in general terms, the electrolyte concentration is such as to provide a solution containing from 1 to 80 wt % of the electrolyte, the solution temperature is set between 5° and 70° C., the current density is set between 5 and 60 A/dm$^2$, the voltage is set between 1 and 100 V, and the electrolysis time is selected appropriately in the range from 10 seconds to 50 minutes. The weight of anodically oxidized film is suitably within the range from 0.1 to 10 g/m$^2$, and preferably within the range from 1 to 6 g/m$^2$.

Moreover, the use of aluminum sheets which have been treated by immersion in an aqueous solution of an alkali metal silicate after the anodizing treatment, as disclosed in JP-B-47-5125, is preferred. Furthermore, silicate electrodeposition as disclosed in U.S. Pat. No. 3,658,662 is also effective. Treatment with poly(vinylsulfonic acid) as disclosed in West German Patent Application (OLS) No. 1,621,478 is also appropriate.

Furthermore, alkali soluble intermediate layers, consisting of casein, poly(vinyl alcohol), ethylcellulose, phenolic resin, styrene/maleic anhydride copolymer or poly(acrylic acid), for example, may be established, as required, between the electrically conductive support and the photoconductive layer in this invention in order to improve adhesion or to improve the electrostatic characteristics of the printing plate for electrophotographic purposes.

Furthermore, an over-coating layer which can be removed at the same time as the photoconductive layer is being removed may be established, as required, over the photoconductive layer, with a view to improving the electrostatic characteristics, the development characteristics during toner development, or the image characteristics or printing characteristics, etc. This over-coating layer may be a layer which has been matted mechanically, or it may consist of a resin which contains a matting agent. In this case, silicon dioxide, glass particles, alumina, starch, titanium oxide, zinc oxide, or particles of a polymer, such as poly(methyl methacrylate), polystyrene, or a phenolic resin, for example, or the matting agents described in U.S. Pat. Nos. 2,701,245 and 2,992,101 can be included as matting agents. Two or more of these matting agents can be used conjointly. The resin which is used to form the over-coating layer is selected appropriately in accordance with the composition of the etching solution with which the photoconductive layer is to be removed. In practice, the resin used is, for example, gum arabic, hide glues, celluloses, starch, poly(vinyl alcohol), poly(ethylene oxide), poly(acrylic acid), polyacrylamide, poly(vinyl methyl ether), epoxy resin, phenolic resin, polyamide or poly(vinyl butyrate). Two or more of these resins can be used conjointly.

Any of the toners used as electrophotographic toners in dry type developers or liquid type developers, which are resistant to the etching solution used to remove the non-image parts, and which have a function which prevents dissolution of the photoconductive layer in the toner image parts in the etching solution can be used as the toner which is used in the invention, but the use of liquid developers is desirable for obtaining high resolution images. Moreover, those which are hydrophobic and which provide a toner image which is inkable are desirable. For example, polymeric substances, such as polystyrene based resins, polyester based resins, homopolymers and copolymers of acrylic esters, homopolymers and copolymers of methacrylic esters, ethylene copolymers, cyclized rubbers, homopolymers or copolymers of vinyl acetate, and vinyl chloride, for example, can be used as toner particle components. Furthermore, colorants, such as carbon black and nigrosin based pigments, and pigments and dyes such as phthalocyanine blue, phthalocyanine green, benzidine yellow, alkali blue and carmine 6B, can be included within such a range that there is no adverse effect on the fixing properties, dispersion properties, or etching resistance of the toner. Moreover, various charge controlling agents and other additives can also be included.

Any solvent capable of removing the photoconductive layer can be used as the etching solution for removing the photoconductive layer of the non-toner image parts after the toner image has been formed, and no particular limitation is imposed thereon. However, the use of alkaline solutions is preferred. These may be aqueous solutions which contain an alkaline compound, or organic solvents which contain an alkaline compound, or mixtures of organic solvents and aqueous solutions which contain an alkaline compound. Any organic or inorganic alkaline compound, for example, sodium hydroxide, potassium hydroxide, sodium carbonate, sodium silicate, potassium silicate, sodium metasilicate, potassium metasilicate, sodium phosphate, potassium phosphate or ammonia, or an aminoalcohol such as monoethanolamine, diethanolamine or triethanolamine, can be used as the alkaline compound.

As mentioned earlier, water and many organic solvents can be used as the solvent for the etching solution, but the use of etching solutions which are mainly water based are preferred from the point of view of both odor and pollution. Various organic solvents can be added, as required, to etching solutions which are manly water based. The etching solutions which are mainly water based can contain various organic solvent, as required. Preferred organic solvents include lower alcohols and aromatic alcohols, such as methanol, ethanol, propanol, butanol, benzyl alcohol and phenethyl alcohol, and ethylene glycol, diethylene glycol, triethylene glycol, polyethylene glycol, cellosolves, and amino alcohols such as monoethanolamine, diethanolamine and triethanolamine. Furthermore, surfactants, anti-foaming agents and other additives can be included, as required, in the etching solutions which are used in the invention.

The method by which a printing plate is prepared form the printing plates for electrophotographic plate making of this invention is described below. Thus, an image is formed on the printing plate for electrophotographic plate making of this invention by means of a conventional electrophotographic process. That is to say, in essence, the plate is charged uniformly in the dark and an electrostatic latent image is formed by imagewise exposure. The exposure can be made as a reflected imagewise exposure or as a contact exposure through a transparent positive image film, using a xenon lamp, tungsten lamp or fluorescent lamp as a light source, or by means of a scanning exposure using laser light or light emitting diodes. In the case of a scanning exposure, the exposure can be made with a laser light source, using a helium/neon laser, helium/cadmium laser, argon ion laser, krypton ion laser, YAG laser, rubidium laser, nitrogen laser, dye laser, excimer laser, or a semiconductor lase such as a GaAs/GaAlAs or InGaAsP laser, or an alexandrite laser, copper vapor laser or an erbium laser, or it can be made using light emitting diodes or a liquid crystal shutter (for example using a light emitting diode array or liquid crystal shutter array line printer type light source).

Dry developing methods (cascade development, magnetic brush development, powder cloud development) or liquid development methods can be used for developing the above mentioned electrostatic latent image by means of a toner. Of these possible methods, the liquid development methods are able to form finely detailed images and they are suitable for forming printing plates. Moreover, positive-positive development with positive development, or negative-positive development with reversal development can be achieved by the imposition of the appropriate bias voltage. The toner image which is formed can be fixed using the known methods, for example, by heat fixing, pressure fixing or solvent fixing. The toner image formed in this way functions as a resist and the printing plate can be formed by removing the photoconductive layer of the non-image parts by means of an etching solution.

ILLUSTRATIVE EXAMPLES

The invention is described in practical detail below by means of examples, but the invention is not limited by these examples. Moreover, the term "parts" as used in the examples signifies in all cases "parts by weight".

EXAMPLE 1

Tris-azo compound (indicated below) as a charge generating agent 1.0 parts

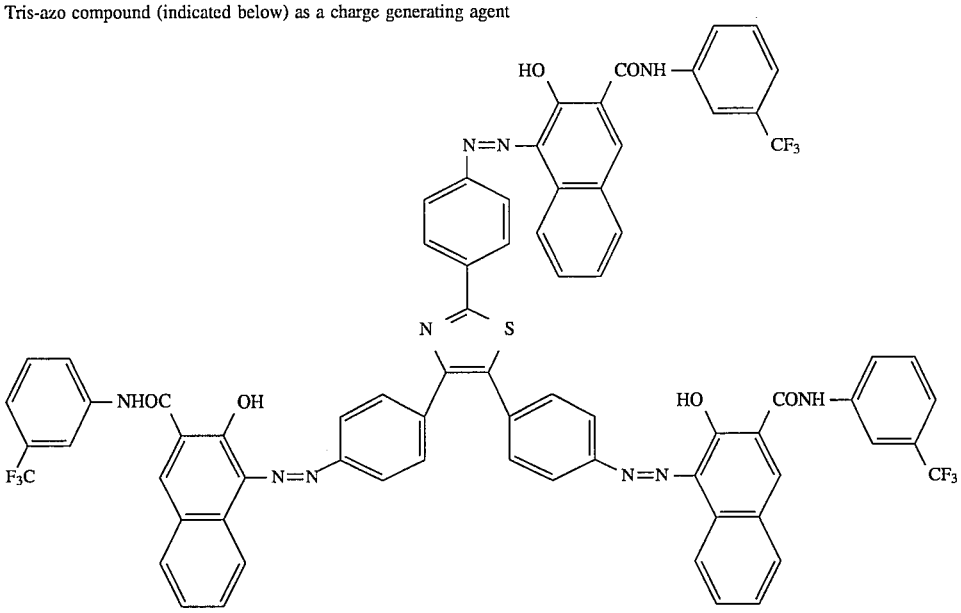

Hydrazone compound (indicated below) as an organic photoconductive compound 2.0 parts

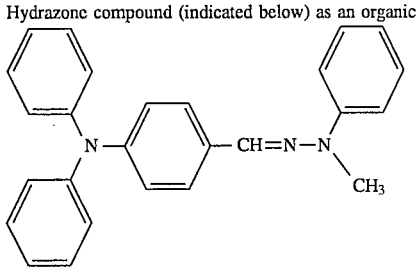

Copolymer (4): 10.0 parts
Tetrahydrofuran: 100 parts

A liquid dispersion for forming a photoconductive layer was prepared by introducing the components indicated above, along with some glass beads, into a glass reactor of capacity 500 ml, dispersing for 60 minutes in a paint shaker (made by Toyo Seiki Seisakujo Co.), and subsequently removing the glass beads by filtration.

The liquid dispersion was coated onto an aluminum sheet of thickness 0.25 mm which had been sanded and dried to provide a printing plate for electrophotographic type plate making which had a photoconductive layer of dry film thickness 5.1 μm.

Next, the response rate of the printing plate for electrophotographic type plate making prepared in this way was measured. Thus, the printing plate was charged in the dark to a surface potential of +400 V using a coronal discharge machine, after which it was exposed to light at a rate of 26 erg/cm$^2$ using a flash lamp which provided a light emission of 35 μ.sec duration and the fall in the surface potential which occurred with the passage of time was measured. The way in which the Surface potential fell with respect to time from the surface potential immediately after exposure to the surface potential observed 60 seconds after exposure was as shown in FIG. 1. The value immediately after exposure is taken to be 100% and the value after 60 seconds is taken to be 0%. The time required for the surface potential to fall to one tenth (to 10%) of the initial value was 2.5 seconds.

Next, the printing plate for electrophotographic type plate making obtained was charge with a coronal discharge of +7.5 kV with a static system using a static copy paper testing machine SPA-8100 (made by Kawaguchi Denki Co.) and exposed using a halogen lamp, and the electrophotographic characteristics were investigated.

The surface potential immediately after charging (V0) and the exposures required to provide a light reduction of the surface potential before exposure to one half (E50) and to one fifth (E80) were obtained as follows:

V0+456 V

E50 3.2 lux.sec.

E80 8.9 lux.sec.

Next, the sample was charged in the dark to a surface potential of +450 V and exposed in such a way as to provide an exposure at the plate surface of 30 erg/cm$^2$ with light of wavelength 633 nm using a He/Ne laser. The exposed plate was developed using a liquid developer, prepared by dispersing 5 grams of poly(methyl methacrylate) grains (particle size 0.3μ) as toner particles in 1 liter of "Isopar H" (Esso Standard Co.) and adding 0.01 gram of soy bean lecithin as a charge controlling agent, with the application of a bias voltage of 30 V to a counter electrode, and a distinct positive toner image was obtained in this way. An image with no fogging in both the write-in start parts and the write-in end parts was obtained.

Moreover, the toner image was fixed by heating at 100° C. for 30 seconds. The non-image parts of this printing plate for electrophotographic type plate making were removed with an etching solution obtained by diluting 40 parts of potassium silicate, 10 parts of potassium hydroxide, and 100 parts of ethanol with 800 parts of water, after which the plate was thoroughly rinsed with water and an offset printing plate was obtained on coating with gum.

When printing in the usual way with the printing plate which had been obtained in this way using an "Hamada Star 600 CD" offset printing press, it was possible to obtain 50,000 very distinctly printed copies with no staining in the non-image parts.

Comparative Example 1

A printing plate for electrophotographic type plate making was prepared in the same way as in Example 1 except that copolymer (A) indicated below was used as the binder resin in place of the copolymer (4).

Copolymer (A):

Styrene/maleic anhydride copolymer (Maleic anhydride content: 33 mol %)

Figure 2:
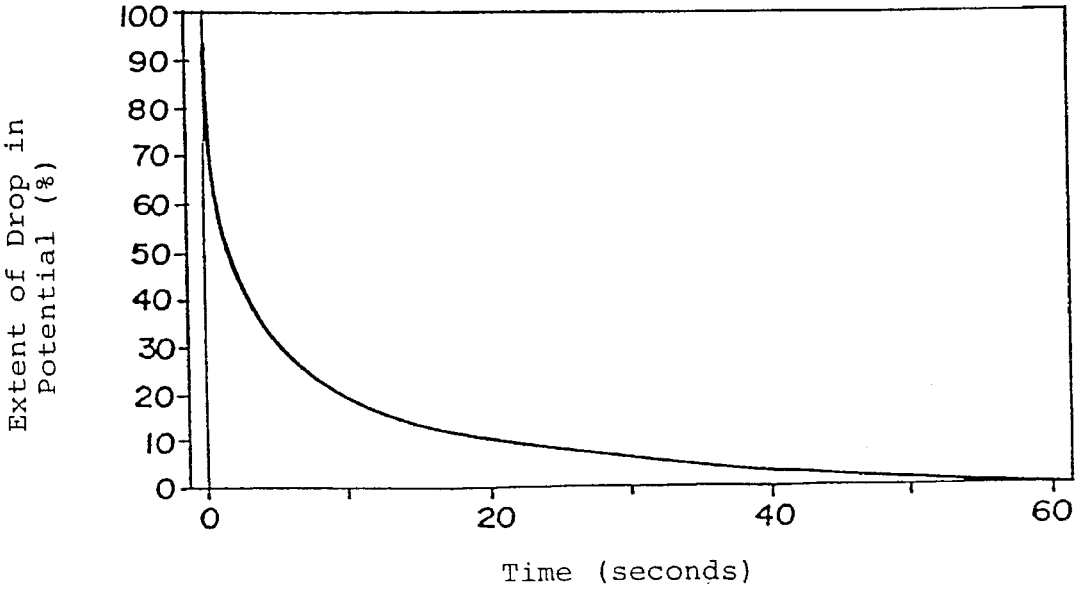

The response rate of the printing plate for electrophotographic type plate making so obtained was measured in the same way as in Example 1 and the results are shown in FIG. 2. The time required for the surface potential to one tenth (to 10%) of the initial value was 20 seconds.

This sample was charged in the dark to a surface potential of +450 V and then exposed using a He/Ne laser to light of wavelength 633 nm in such a way that the exposure at the plate surface was 30 erg/cm$^2$, after which it was developed in the same way, and suing the same liquid developer, as in Example 1. The image obtained, however, was not even, showing no fogging in the parts where image write-in started but with fog produced in the parts where write-in finished.

Moreover, the toner image was fixed by heating at 100° C. for 30 seconds. The non-image parts of this printing plate for electrophotographic type plate making were removed with an etching solution obtained by diluting 40 parts of potassium silicate, 10 parts of potassium hydroxide, and 100 parts of ethanol with 800 parts of water, after which the plate was thoroughly rinsed with water, and an offset printing plate was obtained on coating with gum. When this printing plate was used in a "Hamada Star 600CD" offset printing press, base staining occurred on the prints as a result of printing ink adhering to the parts where fog was retained and it was impossible to obtain distinctly printed material.

In order to obtain an even image with no fogging in the write-in finish part it was necessary to provide a waiting time of 30 to 60 seconds from the end of write-in before starting toner development.

Comparative Example 2

A printing plate for electrophotographic type plate making was prepared in the same way as in Example 1 except that copolymer (B) indicated below was used as the binder resin in place of the copolymer (4).

Copolymer (B):

Vinyl acetate/crotonic acid copolymer ("Resyn-28-1310", made by the Kanebo NSC Company)

Figure 3:
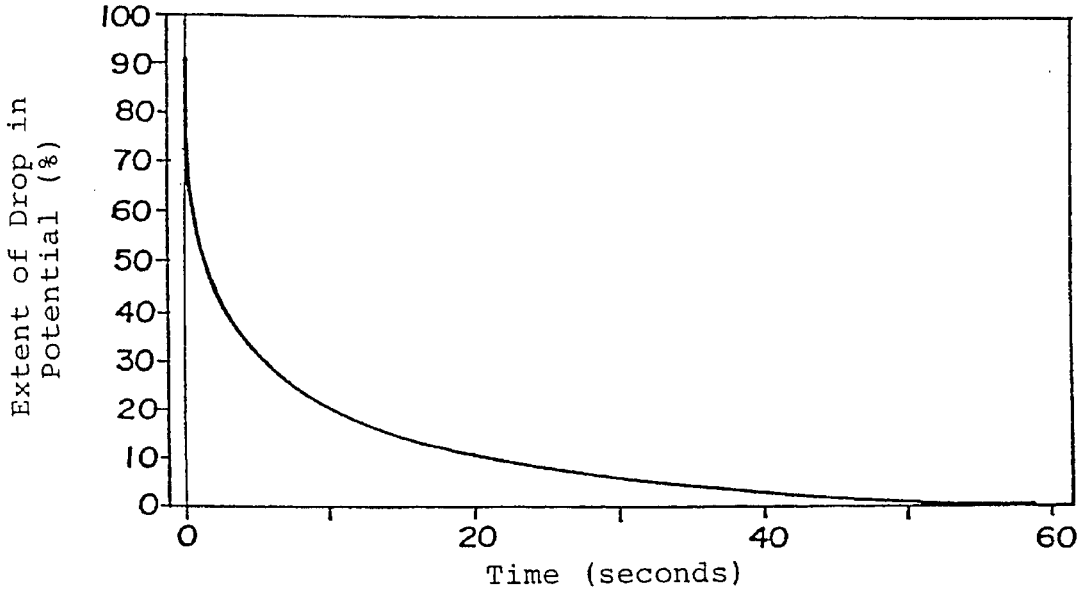

The response rate of the printing plate for electrophotographic type plate making so obtained was measured in the same way as in Example 1 and the results are shown in FIG. 3. The time required for the surface potential to fall to one tenth (to 10%) of the initial value was 20 seconds.

Comparative Example 3

A printing plate for electrophotographic type plate making was prepared in the same way as in Example 1 except that copolymer (C) indicated below was used as the binder resin in place of the copolyemr (4).

Copolymer (C):

Isobutyl methacrylate/methacrylic acid (60:40)

Figure 4:
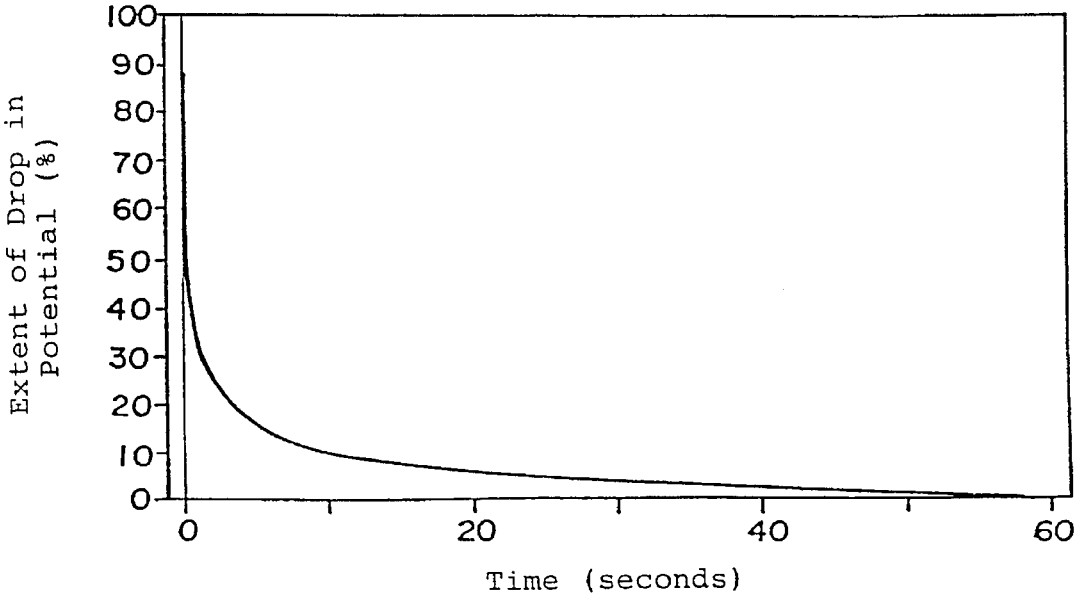

The response rate of the printing plate for electrophotographic type plate making so obtained was measured in the same way as in Example 1 and the results are shown in FIG. 4. The time required for the surface potential to fall to one tenth (to 10%) of the initial value was 10 seconds.

Comparative Example 4

A printing plate for electrophotographic type plate making was prepared in the same way as in Example 1 except that copolymer (D) indicated below was used as the binder resin in place of the copolymer (4).

Copolymer (D):

Cyclohexyl methacrylate/methacrylic acid (60:40)

Figure 5:
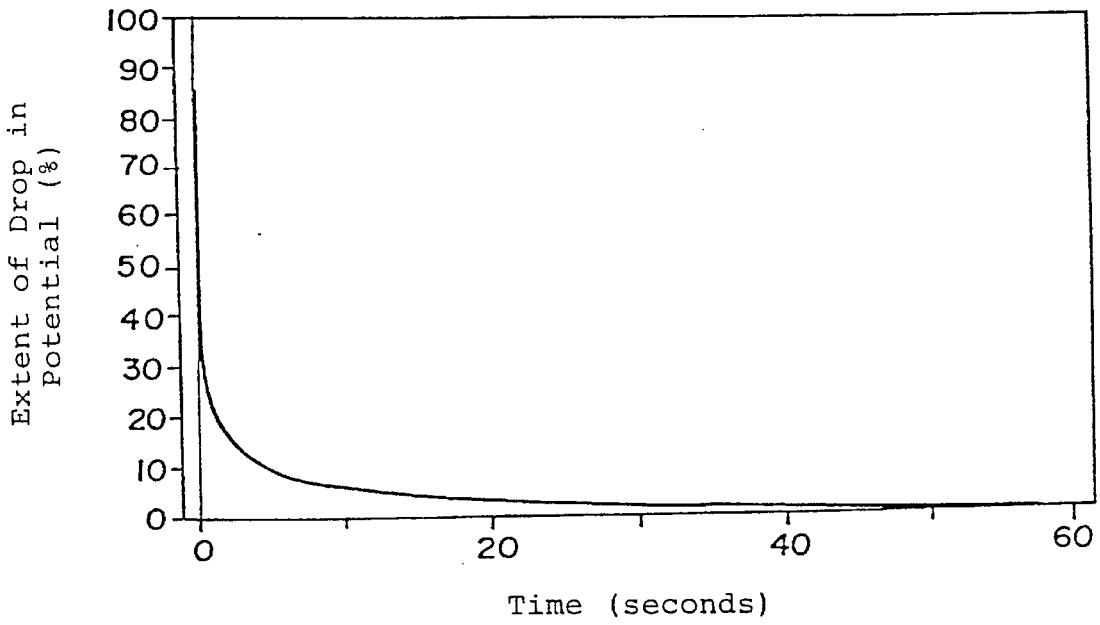

The response rate of the printing plate for electrophotographic type plate making so obtained was measured in the same way as in Example 1 and the results are shown in FIG. 5. The time required for the surface potential to fall to one tenth (to 10%) of the initial value was 5 seconds.

Examples 2 to 11

Printing plates for electrophotographic type plate making were prepared in the same way as in Example 1 except that copolymers (1), (2), (3), (5), (7), (9), (11), (12), (16) and (17) were used in place of the copolymer (4).

The response rates of the printing plates for electrophotographic type plate making so obtained were measure in the same way as in Example 1, and the times required for the surface potential to fall to one tenth (to 10%) of the initial value were obtained. The results obtained are shown in Table 1.

TABLE 1

| | Copolymer | Response Time (10%) |
|---|---|---|
| Example 2 | (1) | 1.4 seconds |
| Example 3 | (2) | 2.5 seconds |
| Example 4 | (3) | 1.9 seconds |
| Example 5 | (5) | 3.5 seconds |
| Example 6 | (7) | 2.4 seconds |
| Example 7 | (9) | 2.6 seconds |
| Example 8 | (11) | 2.4 seconds |
| Example 9 | (12) | 2.6 seconds |
| Example 10 | (16) | 2.1 seconds |
| Example 11 | (17) | 2.2 seconds |

Example 12

A printing plate for electrophotographic type plate making was prepared in the same way as in Example 1 except that the oxadiazole compound indicated below was used as the organic photoconductive compound in place of the hydrazone compound.

The response rate of the printing plate for electrophotographic type plate making so obtained was measured in the same way as in Example 1 and the time required for the surface potential to fall to one tenth (to 10%) of the initial value was 2.6 seconds.

Oxadiazole Compound:

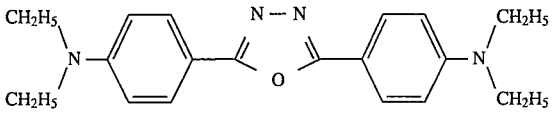

Example 13

| | |
|---|---|
| Hydrazone compound (indicated below) as an organic photoconductive compound: | 25 parts |

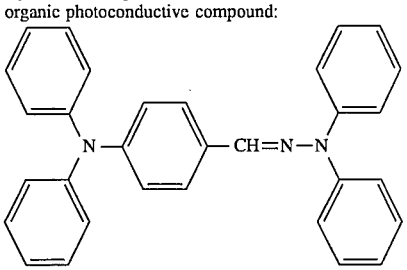

| | |
|---|---|
| Compound (8), as a binder resin: | 75 parts |
| Thiopyrylium salt compound as a sensitizing dye: | 1.18 part |

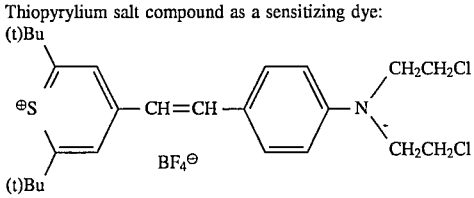

The components indicated above were dissolved in a mixed solvent comprising 510 parts of methylene chloride and 150 parts of methylcellosolve acetate.

This solution was coated onto an aluminum sheet of thickness of 0.25 mm which had been sanded and dried to provide a printing plate for electrophotographic type plate making which had a photoconductive layer of dry film thickness of 5.3 μm.

Next, the sample was charged in the dark to a surface potential +450 V and exposed to light of wavelength 632 nm using a He/Ne laser. The exposed plate was developed using a liquid developer, prepared by dispersing 5 grams of poly(methyl methacrylate) grains (particle size 0.3 μm) as toner particles in 1 liter of "Isopar H" (Esso Standard Co.) and adding 0.01 gram of soy bean lecithin as a charge controlling agent, and a distinct positive toner image with no fogging in either the write-in start parts or the write-in finish parts was obtained.

Moreover, the toner image was fixed by heating at 100° C. for 30 seconds. The photosensitive layer which has no toner attachement in the non-image parts of this printing plate for electrophotographic type plate making was removed completely by immersion for about 1 minute in a etching solution obtained by dissolving 70 grams of hydrated sodium metasilicate in 140 ml of glycerine, 550 ml of ethylene glycol and 150 ml of ethanol, and then rinsing the plate while brushing lightly.

When printing in the usual way with the printing plate which had been obtained in this way using an "Hamada Star 600 CD" offset printing press, it was possible to obtain 50,000 very distinctly printed copies with no staining in the non-image parts.

The printing plates for electrophotographic type plate making of this invention are excellent plates which have an improved response rate, and a shortening of the process time of the plate making operation has been realized in this way. Furthermore, the problem of the occurrence of fogging which arises because of the rise in residual potential in the parts where write-in finishes due to the slow response rate on direct type printing plates with which a scanning exposure system with a laser for example is being used can be overcome with printing plates for electrophotographic type plate making of this invention, so that good printing plates with no fogging in the write-in start and finish parts can be obtained.

While the invention has been described in detail and with reference to specific examples thereof, it will be apparent to one skilled in the art that various changes and modifications can be made therein without departing from the spirit and scope thereof.

What is claimed is:

1. A printing plate for electrophotographic plate making which is formed of at least a photoconductive layer comprising an organic photoconductive compound and a binding resin on an electrically conductive support and with which printing plates are made by removing the photoconductive layer of the non-image parts other than toner image parts after imagewise exposure and forming a toner image, wherein said binding resin of the photoconductive layer comprises a copolymer including (1) an acrylic acid ester or methacrylic acid ester containing an aromatic ring in at least one monomer component thereof and (2) a vinyl polymerizable monomer having one to three acidic functional groups and present in an amount of from 50 to 60 mol % based on total monomer content of the copolymer.

2. The printing plate of claim 1, wherein the aromatic ring is an aromatic hydrocarbon group or an aromatic heterocyclic group.

3. The printing plate of claim 2, wherein the monomer having the aromatic ring is a substituted or unsubstituted benzyl acrylate, a substituted or unsubstituted benzyl methacrylate, a substituted or unsubstituted phenethyl acrylate, a substituted or unsubstituted phenethyl methacrylate, a substituted or unsubstituted phenyl acrylate or a substituted or unsubstituted phenyl methacrylate.

4. The printing plate of claim 2, wherein the acrylic acid ester or methacrylic acid ester having an aromatic ring has as its ester residue an aromatic hydrocarbon group selected from the group consisting of phenyl group, o-tolyl group, m-tolyl group, p-tolyl group, p-tert-butylphenyl group, chlorophenyl group, benzyl group, o-methylbenzyl group, m-methylbenzyl group, p-methylbenzyl group, p-ethylbenzyl group, p-propylbenzyl group, 2-phenylethyl group, 2-(p-methylphenyl)ethyl group, 2-(o-methylphenyl)ethyl group, 3-phenylpropyl group, α-naphthylmethyl group, and β-naphthylphenyl group.

5. The printing plate of claim 2, wherein the acrylic acid ester or methacrylic acid ester which has an aromatic ring has an ester residue of an aromatic heterocyclic group selected from the group consisting of 2-pyridinomethyl, 4-pyridinomethyl, imidazolymethyl, 4-indolylmethyl, pyrimidinomethyl, thiazolymethyl, furan, thiophene, pyrrole, pyran, thiopyran, thiazole, imidazole, pyrimidine, triazine, indole, quinoline, and purine.

6. The printing plate of claim 1, wherein the vinyl polymerizable monomer having the acidic functional group is acrylic acid or methacrylic acid.

7. The printing plate of claim 6, wherein the acidic functional group is selected from the group consisting of a carboxylic acid group, an acid anhydride group, a hydroxyl group, a phenolic hydroxyl group, a sulfonic acid group, a sulfonamido group, and a sulfonimido group.

8. The printing plate of claim 1, wherein the binder contains a vinyl polymerizable monomer other than monomers (1) and (2) as a third copolymer component.

9. The printing plate of claim 1, in which the copolymer has a molecular weight of from 1,000 to 500,000.

10. The printing plate of claim 1, wherein the photoconductive layer comprises organic photoconductive compounds, sensitizing dyes and binder resins.

11. The printing plate of claim 1, wherein the photoconductive layer comprises a charge generating agent, a charge transporting agent and a binder resin.

12. The printing plate of claim 1, wherein the electrically conductive support comprises a hydrophilic surface.

13. The printing plate of claim 12, wherein the electrically conductive support is formed of a plastic sheet, paper impermeable to solvents or an electrically conductive aluminum, zinc, bimetal or trimetal sheet.

14. The printing plate of claim 1, in which the support is an aluminum sheet which has been roughened and anodized.

15. The printing plate of claim 1, in which the vinyl polymerizable monomer containing one to three acidic functional groups is acrylic acid, methacrylic acid, crotonic acid, maleic acid, phthalic acid, maleic anhydride, p-carboxystyrene, p-hydroxystyrene, p-hydroxyphenylacrylamide, hydroxyethylmethacrylate, hydroxyethylmethacrylamide or p-vinylbenzenesulfonic acid.

* * * * *